US010693235B2

(12) United States Patent
Chen

(10) Patent No.: US 10,693,235 B2
(45) Date of Patent: Jun. 23, 2020

(54) PATCH ANTENNA ELEMENTS AND PARASITIC FEED PADS

(71) Applicant: The Government of the United States, as represented by the Secretary of the Army, Washington, DC (US)

(72) Inventor: Shuguang Chen, Bel Air, MD (US)

(73) Assignee: The Government of the United States, as represented by the Secretary of the Army, Washington, DC (US)

( * ) Notice: Subject to any disclaimer, the term of this patent is extended or adjusted under 35 U.S.C. 154(b) by 79 days.

(21) Appl. No.: 15/869,166

(22) Filed: Jan. 12, 2018

(65) Prior Publication Data

US 2019/0221935 A1 Jul. 18, 2019

(51) Int. Cl.
*H01Q 9/04* (2006.01)
*H01Q 21/08* (2006.01)
*H01Q 21/30* (2006.01)

(52) U.S. Cl.
CPC ..... *H01Q 9/045* (2013.01); *H01Q 9/0414* (2013.01); *H01Q 21/08* (2013.01); *H01Q 21/30* (2013.01)

(58) Field of Classification Search
CPC ..... H01Q 9/045; H01Q 21/061; H01Q 3/26; H01Q 1/246; H01Q 21/28; H01Q 1/244
USPC ..... 343/893, 725, 729, 737, 751
See application file for complete search history.

(56) References Cited

U.S. PATENT DOCUMENTS 6,091,373 A * 7/2000 Raguenet ..... H01Q 9/0414 333/137
6,624,786 B2 9/2003 Boyle
8,063,832 B1 11/2011 Weller et al.
8,159,409 B2 4/2012 Harokopus et al.
8,522,421 B2 9/2013 Chen et al.
8,599,072 B2 12/2013 Reed et al.
8,860,613 B2 10/2014 Andrenko
8,952,851 B1 2/2015 Hsu et al.
8,963,793 B2 2/2015 Saliga et al.
2003/0146872 A1* 8/2003 Kellerman ..... H01Q 9/0414 343/700 MS
2007/0126638 A1* 6/2007 Channabasappa ... H01Q 9/0407 343/700 MS
2011/0209338 A1 9/2011 Chen et al.
2011/0260928 A1 10/2011 Ito et al.
2012/0229364 A1 9/2012 Nakabayashi et al.
2012/0280888 A1 11/2012 Thiam et al.
2012/0287002 A1 11/2012 Parsche
2012/0287017 A1 11/2012 Parsche
2012/0287018 A1 11/2012 Parsche
2013/0082879 A1 4/2013 Fuchs et al.
2013/0147682 A1 6/2013 Schadler
2013/0180967 A1 7/2013 Teng et al.
(Continued)

*Primary Examiner* — Andrea Lindgren Baltzell
(74) *Attorney, Agent, or Firm* — Ronald Krosky; Azza Jayaprakash

(57) ABSTRACT

Various embodiments are described that relate to patch antenna elements and parasitic feed pads. A patch antenna element can have a resistance and reactance. The resistance can be desirable while the reactance can be undesirable. To counteract the reactance, a parasitic feed pad can be placed near the patch antenna element and the parasitic feed pad produces a capacitance. The capacitance balances out the reactance to cancel out one another. When two patch antenna elements and two parasitic feed elements are employed in one antenna stack, the stack antenna can function as a dual band antenna.

20 Claims, 8 Drawing Sheets

(56) References Cited

U.S. PATENT DOCUMENTS

| | | | | |
|---|---|---|---|---|
| 2013/0265203 | A1 | 10/2013 | Ermutlu et al. | |
| 2013/0271344 | A1 | 10/2013 | Tasaki et al. | |
| 2014/0198014 | A1 | 7/2014 | Fasenfest | |
| 2015/0194734 | A1 | 7/2015 | Chiu | |
| 2015/0194999 | A1 | 7/2015 | Lea et al. | |
| 2017/0047656 | A1 | 2/2017 | Bocskor et al. | |
| 2019/0044235 | A1* | 2/2019 | Cheng | H01Q 9/0414 |

* cited by examiner

PATCH ANTENNA ELEMENTS AND PARASITIC FEED PADS

GOVERNMENT INTEREST

The innovation described herein may be manufactured, used, imported, sold, and licensed by or for the Government of the United States of America without the payment of any royalty thereon or therefor.

BACKGROUND

Many different organizations and industries can use wireless communications. In one example, wireless communications can be along a specific frequency. As a specific example of wireless communication, a radio station can broadcast at a specific frequency. There can be benefits to improving wireless communication.

SUMMARY

In one embodiment, a system comprises a first patch antenna element configured to operate at a first base frequency and operate with a first resistance and a first inductance. In addition, the system comprises a first parasitic feed pad configured to produce a first capacitance configured to at least partially cancel the first inductance. Also, the system comprises a second patch antenna element configured to operate at a second base frequency and operate with a second resistance and a second inductance, where the first base frequency and the second base frequency are different frequencies. Additionally, the system comprises a second parasitic feed pad configured to produce a second capacitance configured to at least partially cancel the second inductance, In another embodiment, a method comprises causing excitation of a first patch antenna element to operate at a first base frequency and operate with a first resistance and a first inductance. In this embodiment, the method also comprises causing excitation of a second patch antenna element to operate at a second base frequency and operate with a second resistance and a second inductance. A parasitic feed pad set, comprising a first parasitic feed pad and a second parasitic feed pad, produces a capacitance that compensates for the first inductance and the second inductance.

In yet another embodiment, a system comprises a first impedance calculation component, a second impedance calculation component, a first capacitance calculation component, a second capacitance calculation component, a distance calculation component, an output component. The first impedance calculation component can be configured to calculate an anticipated first impedance of a first patch antenna element. The second impedance calculation component can be configured to calculate an anticipated second impedance of a second patch antenna element. The first capacitance calculation component can be configured to calculate an anticipated first capacitance of a first parasitic feed pad. The second capacitance calculation component can be configured to calculate an anticipated second capacitance of a second parasitic feed pad. The distance calculation component can be configured to calculate a distance set based, at least in part, on the anticipated first impedance, the anticipated second impedance, the first anticipated capacitance, and the second anticipated capacitance. The output component can be configured to output the distance set to a construction component configured to construct a patch antenna in accordance with the distance set. The distance set can comprise a distance between the first patch antenna element and the first parasitic feed pad, a distance between the first parasitic feed pad and the second patch antenna element, and a distance between the second patch antenna element and the second parasitic feed pad. The construction component can be configured to construct the patch antenna as a stack antenna. The patch antenna can comprise the first patch antenna element, the first parasitic feed pad, the second patch antenna element, and the second parasitic feed pad. The first parasitic feed pad can separate the first patch antenna element and the second patch antenna element in the stack. The second patch antenna element can separate the first parasitic feed pad and the second parasitic feed pad in the stack. The first impedance calculation component, the second impedance calculation component, the first capacitance calculation component, the second capacitance calculation component, the distance component, the output component, or a combination thereof can be implemented, at least in part, by way of non-software.

BRIEF DESCRIPTION OF THE DRAWINGS

Incorporated herein are drawings that constitute a part of the specification and illustrate embodiments of the detailed description. The detailed description will now be described further with reference to the accompanying drawings as follows.

DETAILED DESCRIPTION

Figure 1A:
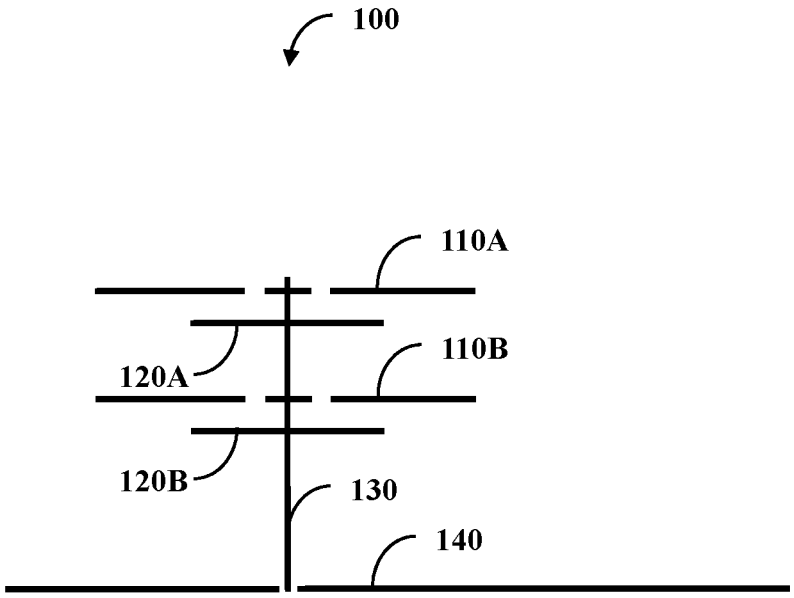
FIGS. 1A and 1B illustrate embodiments of views of a stack antenna comprising a first antenna patch element, a second antenna patch element, a first parasitic feed element, a second parasitic feed element, a probe feed, and a ground plane.

Antennas can have an inductance. The inductance can be introduced by an antenna element (e.g., dipole antenna element) or other features, such as a probe feed used to excite the antenna elements. This inductance can be undesirable as it can limit a bandwidth for the antenna.

To counteract this inductance, a capacitance can be introduced. One way of introducing this capacitance is by adding a parasitic feed pad. The probe feed can connect directly to the parasitic feed pad and excite the parasitic feed pad. This excitement can cause the antenna element to also be excited in a parasitic manner. The inductance of the antenna element, as well as other introduced inductance, can be cancelled by the capacitance of the parasitic feed pad.

To achieve greater performance, multiple antenna elements can be introduced along with multiple parasitic feed pads in a single stack antenna. These elements and pads can be precisely sized and spaced to achieve desired (e.g., optimal) performance. This can allow for a net inductance and capacitance for the entire stack antenna to be near zero.

The following includes definitions of selected terms employed herein. The definitions include various examples. The examples are not intended to be limiting.

"One embodiment", "an embodiment", "one example", "an example", and so on, indicate that the embodiment(s) or example(s) can include a particular feature, structure, characteristic, property, or element, but that not every embodiment or example necessarily includes that particular feature, structure, characteristic, property, or element. Furthermore, repeated use of the phrase "in one embodiment" may or may not refer to the same embodiment.

"Computer-readable medium", as used herein, refers to a medium that stores signals, instructions and/or data. Examples of a computer-readable medium include, but are not limited to, non-volatile media and volatile media. Non-volatile media may include, for example, optical disks, magnetic disks, and so on. Volatile media may include, for example, semiconductor memories, dynamic memory, and so on. Common forms of a computer-readable medium may include, but are not limited to, a floppy disk, a flexible disk, a hard disk, a magnetic tape, other magnetic medium, other optical medium, a Random Access Memory (RAM), a Read-Only Memory (ROM), a memory chip or card, a memory stick, and other media from which a computer, a processor or other electronic device can read. In one embodiment, the computer-readable medium is a non-transitory computer-readable medium.

"Component", as used herein, includes but is not limited to hardware, firmware, software stored on a computer-readable medium or in execution on a machine, and/or combinations of each to perform a function(s) or an action (s), and/or to cause a function or action from another component, method, and/or system. Component may include a software controlled microprocessor, a discrete component, an analog circuit, a digital circuit, a programmed logic device, a memory device containing instructions, and so on. Where multiple components are described, it may be possible to incorporate the multiple components into one physical component or conversely, where a single component is described, it may be possible to distribute that single component between multiple components.

"Software", as used herein, includes but is not limited to, one or more executable instructions stored on a computer-readable medium that cause a computer, processor, or other electronic device to perform functions, actions and/or behave in a desired manner. The instructions may be embodied in various forms including routines, algorithms, modules, methods, threads, and/or programs, including separate applications or code from dynamically linked libraries.

FIG. 1A illustrates one embodiment of a profile view 100 of a stack antenna comprising a first antenna patch element 110A, a second antenna patch element 110B, a first parasitic feed element 120A, a second parasitic feed element 120B, a probe feed 130, and a ground plane 140. The stack antenna can function as a dual-band high gain antenna. The dual-band antenna can be used in global positioning system (GPS) applications, such as with a first band for commercial GPS applications and a second band for military GPS applications.

The first patch antenna element 110A can be configured to operate at a first base frequency (center frequency for the first band) and operate with a first resistance and a first inductance. Similarly, the second patch antenna element 110B can be configured to operate at a second base frequency, different from the first base frequency, and operate with a second resistance and a second inductance. Inductance can be undesirable because the inductance can limit the range of the first band and second band.

To at least partially remove the inductance, the stack antenna includes parasitic feed pads 120A and 120B. The first parasitic feed pad 120A can be configured to produce a first capacitance configured to at least partially cancel the first inductance. Similarly, the second parasitic feed pad 120B can be configured to produce a second capacitance configured to at least partially cancel the second inductance. This means that the second capacitance can reduce, but not eliminate the inductance, the second capacitance can perfectly eliminate the inductance, or the second capacitance can overcompensate for the inductance such that there is excess capacitance (the excess capacitance can negatively influence the frequency band.

Mathematically, the resistance can be considered a real part and the inductance/capacitance can be an imaginary part. A frequency band can be improved when the imaginary part is about zero. For example, without the feed pads 120A and 120B, the frequency bands can be about ±2-3%. However, inclusion of the feed pads 120A and 120B can cause the frequency bands to be about ±5% or greater, such as when elimination is perfect the spread can be about ±15% or greater (e.g., perfect elimination is when the imaginary part is zero).

While the stack antenna may appear to simply be a repetition of a single antenna element-feed pad scenario, the actual implementation can be more complex. With a stack antenna, it can be desirable to have a low physical profile. With this, it can be desirable to have the elements as close together as possible. Two influences on how the feed pads 120A and 120B eliminate inductance of the elements 110A and 110B are distance from the elements 110A and 110B as well as the physical shape (e.g., size) of the feed pads 120A and 120B. However, when the elements 110A and 110B and the pads 120A and 120B are close together, they can start to interfere with one another. As an example, when the stack is close together, the first capacitance can influence the first and the second impedance. Therefore, simply stacking antennas may not produce a useful result. To obtain a useful result, the elements 110A and 110B and the pads 120A and 120B can be tuned to work together—with this tuning, distances can be selected between elements and pads, the elements, and the pads to produce a reduced (e.g., zero) inductance and capacitance. With this, the first capacitance can be configured to at least partially cancel the second inductance (e.g., along with the first inductance) and the second capacitance can be configured to at least partially cancel the first inductance (e.g., along with the second inductance).

The probe feed 130 configured to excite the first patch antenna element 110A, the first parasitic feed pad 120A, the second patch antenna element 110B, and the second parasitic feed pad 120B. Excitement of the probe feed 130 can be such that right hand polarization is achieved, left hand polarization is achieved, or linear polarization is achieved. The probe feed 130 can be at the center of the ground plane 140 or be off-center (illustrated off-center). In one embodiment, the probe feed directly coupled with the feed pads 120A and 120B, but not directly with the elements 110A and 110B. In one embodiment, the probe feed 130 can introduce its own inductance and at least one of the feed pads 120A and/or 120B can cancel the probe feed inductance as well.

The stack antenna can be configured to alternate between a feed pad 120 and an antenna element 110. With this configuration, the first parasitic feed pad 120A can separate the first patch antenna element 110A and the second patch antenna element 110B in the stack. Also with this configuration, the second patch antenna element 110B can separates the first parasitic feed pad 120A and the second parasitic feed pad 120B. Additionally, the configuration can be such that the second parasitic feed pad 120B separates the second patch antenna element 110B from the ground plane 140.

Figure 1B:
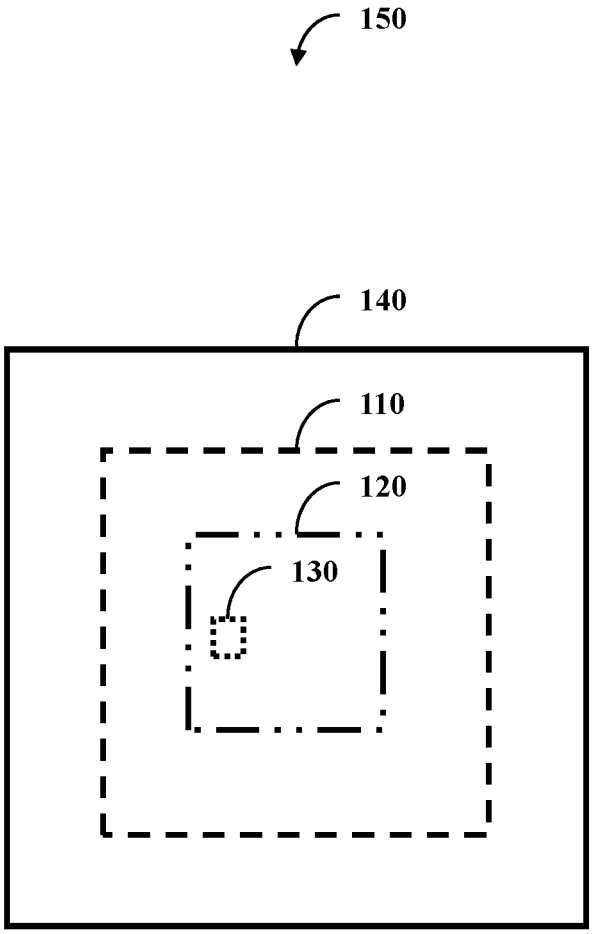

FIG. 1B illustrates one embodiment of a top-down view 150 of the stack antenna. The antenna elements 110A and 110B are illustrated as 110 since, if they are in line with one another, their profile would be the same and the same goes for feed pads 120A and 120B being illustrated as 120. However, while illustrated as being the same size, the elements 110 and/or pads 120 can be different in size and therefore have different profiles (e.g., antenna element 110A is of a different length and width than antenna element 110B). The stack antenna can be a high gain microstrip stacked patch antenna used as a single high gain antenna or as a single element for an antenna array (e.g., adaptive anti jamming antenna array). The multiple antenna elements 110 can experience detuning due to mutual coupling. The feed pads 120 can compensate for this decoupling.

Figure 1C:
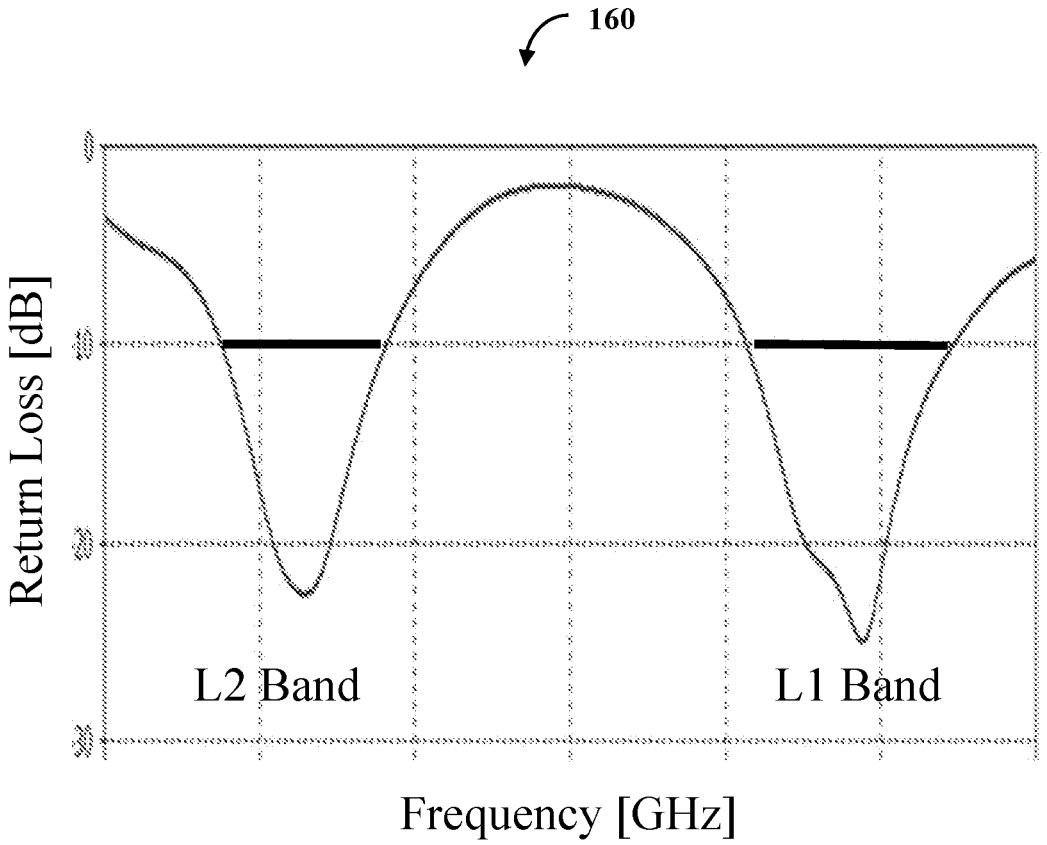
FIG. 1C illustrates one embodiment of a graph.

FIG. 1C illustrates one embodiment of a graph 160. The graph 160 is set as Return Loss (in Decibels (dB)) against Frequency (in gigahertz (GHz)). The graph 160 illuminates the functionality of the stack antenna with the antenna elements 110 and the feed pads 120. The antenna elements 110 can be Printed Circuit Boards (PCB). Antenna element 110A can be optimized for a first band (e.g., frequency band L1) and antenna element 110B can be optimized for a second band (e.g., frequency band L2). The parasitic feed pads 120 can be copper pads that counter the antenna elements 110.

In response to being excited, the first patch antenna can operate at a first band (L1) with a center of about the first base frequency. The first band has a spread of greater than 3% of the first base frequency. Similarly, in response to being excited, the second patch antenna can operate at a second band (L2) with a center of about the second base frequency. Due to the inclusion of the feed pads 120, the spread of the bands is greater than about 3% of the respective base frequency.

In one example, the first base frequency can be about 1575 GHz. The spread can be about 5% (e.g., achieved when the first inductance and the first capacitance about perfectly cancel each other out). With this, the bandwidth of the first band L1 can be about 78.75 megahertz (MHz). The second base frequency can be at about 1.227 GHz. With the spread being about 5%, the bandwidth for the second band L2 can be about 61.35 MHz.

Frequency bandwidth (BW) can be defined as BW=(Fh−Fl)/Fo×100%. The Fh stands for high end of the working frequency band, Fl stands for low end of the working frequency band, and Fo standards for the center working frequency.

In one embodiment, the first band L1 and second band L2 are adjacent (e.g., perfectly adjacent or about adjacent). In one embodiment, the first band L1 and second band L2 are not adjacent and not overlap. With this, the stack antenna can function with two distinct bands.

The stack antenna can be part a sub-array that is part of a larger antenna array. In one example, multiple stack antennas can be placed on a vehicle. The different stack antennas can allow for a greater overall Frequency BW to be observed.

Figure 2:
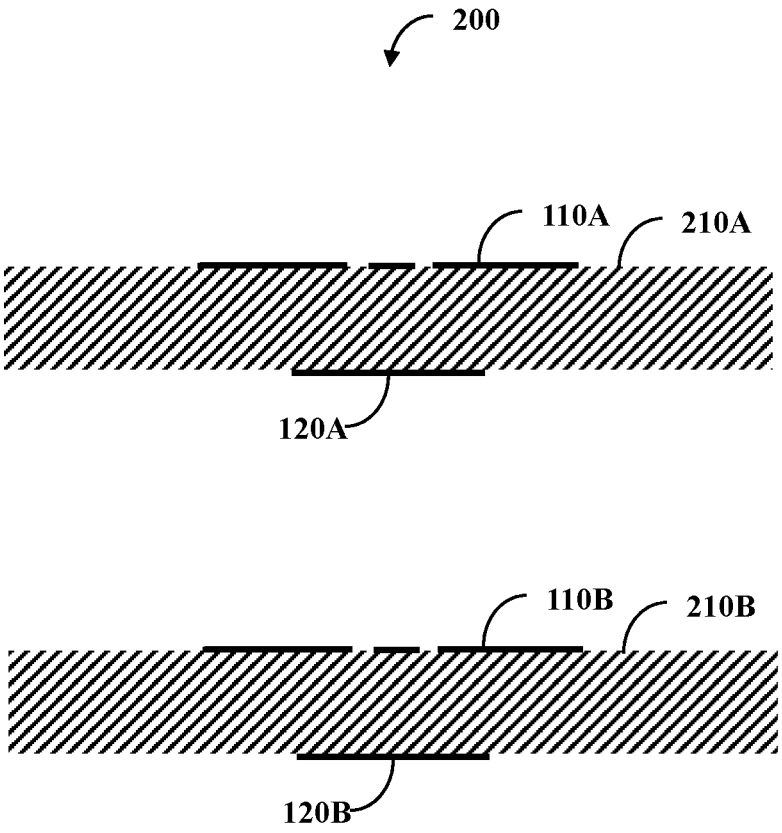
FIG. 2 one embodiment a stack antenna with substrate comprising first antenna patch element, a second antenna patch element, a first parasitic feed element, a second parasitic feed element, a first substrate material, and a second substrate material.

FIG. 2 one embodiment a stack antenna with substrate 200 comprising first antenna patch element 110A, a second antenna patch element 110B, a first parasitic feed element 120A, a second parasitic feed element 120B, a first substrate material 210A, and a second substrate material 210B. While air can separate the patch antenna elements 110 from the parasitic feeds 120, these can also be separated by the substrate materials 210A and 210B. In one example, the patch antenna element 110A can be coupled to a first side of the substrate material 210A. Likewise, the parasitic feed pad 120A can be coupled to a second side of the substrate material 210A that is opposite the first side of the substrate material.

In one embodiment, the substrate material 210 (collectively referring to the substrates 210A and 210B) is used to secure the probe feed wire 130 of FIG. 1 (collectively FIGS. 1A and 1B). The parasitic feed pads 120 can individually have a hole. The probe feed wire 130 of FIG. 1 can pass through the hold and attach to the substrate material 210. Attachment can occur at the end of the probe feed wire 130 of FIG. 1 or elsewhere on the probe feed wire 130 of FIG. 1. The patch antenna element 110 can have a physical separation and the probe feed wire 130 can pass through the physical separation as well as the parasitic feed pad 120 while being attached to the substrate material 210 or elsewhere that is not the patch antenna element 110 (e.g., when the substrate material 210 is not used).

The substrate material 210 can be a printed circuit board material with copper on each side of the board and an object of a certain thickness in between both layers of copper. The patch antenna element 110 can be etched or milled onto one side of the copper board and likewise the parasitic feed pad can 120 be on the opposite side of the board. The thickness of the board can be selected such that it creates the desired separation distance between the patch antenna element 110 and the parasitic feed pad 120. Substrate material thickness can have a great influence on the capacitance introduced to the system 200 as well as the ability for the parasitic feed pad 120 to couple energy onto the patch antenna element 110 (e.g., radiating patch element). The substrate thickness can be tightly controlled since the manufacturing tolerance of commercial printed circuit boards can typically be extremely reliable. Once both sides of the printed circuit board are etched or milled, the probe wire feed 130 of FIG. 1 can be solder connected with the parasitic feed pad 120 or otherwise fixed. Connection can occur such that the probe feed wire 130 of FIG. 1 is orthogonal to the parasitic feed pads 120 and the patch antenna elements 110 are parallel to the ground plane 140 of FIG. 1.

Figure 3:
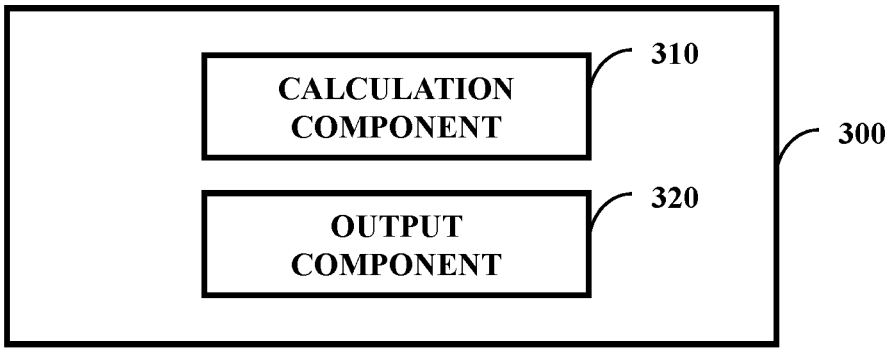
FIG. 3 illustrates one embodiment of a system comprising a calculation component and an output component.

FIG. 3 illustrates one embodiment of a system 300 comprising a calculation component 310 and an output component 320. In one embodiment, the calculation component 310 can function with seven modules. These seven modules can include first and second impedance calculation components, first and second capacitance calculation components, first and second size calculation components, and a distance calculation component.

The first impedance calculation component can be configured to calculate an anticipated first impedance of the first patch antenna element 110A of FIG. 1. The second impedance calculation component can be configured to calculate an anticipated second impedance of the second patch antenna element 110B of FIG. 1. In one example, the size of the antenna elements 110 can be evaluated (e.g., physically evaluated or a technician input the dimensions) and based on this the anticipate impedances are calculated.

The first capacitance calculation component can be configured to calculate an anticipated first capacitance of a first parasitic feed pad 120A of FIG. 1. The second capacitance calculation component configured to calculate an anticipated second capacitance of the second parasitic feed pad 120B of FIG. 1. Similar to the anticipated impedances, the anticipated capacitances can be based on an evaluation of the feed pads 120 of FIG. 1.

The distance calculation component can be configured to calculate a distance set based, at least in part, on the anticipated first impedance, the anticipated second impedance, the first anticipated capacitance, and the second anticipated capacitance. The distance set can comprise a distance between the first patch antenna element and the first parasitic feed pad, a distance between the first parasitic feed pad and the second patch antenna element, and a distance between the second patch antenna element and the second parasitic feed pad. Impedance and capacitance may be impacted by physical distances. The anticipated impedances and capacitances can be initially determined with no distance between the antenna elements 110 of FIG. 1 and the feed pads 120 of FIG. 1. If the inductances and capacitances do not cancel one another out, then the distance component can calculate how far to space out the antenna elements 110 of FIG. 1 and the feed pads 120 of FIG. 1 from one another and from the ground plane 140 of FIG. 1. This can be a complex calculation since moving one item (e.g., the first feed pad 120A) can influence the inductances and capacitances of the other items. In one example, the distance calculation component can perform a trial-and-error calculation set to maximize the elimination of the imaginary part (the sum of the capacitance and impedance being as close as possible to zero). As an example of trial-and-error, the distance calculation component can continue until the sum reaches a tolerance (e.g., the sum is $1/100$ when compared to the resistance).

The output component 320 can be configured to output the distance set to a construction component. The construction component can be configured to construct a patch antenna in accordance with the distance set. With this, the construction component can be configured to construct the patch antenna as a stack antenna, such as what is illustrated in FIG. 1 (collectively referring to FIGS. 1A-1C, though FIG. 1C does not illustrate a view of the stack antenna).

What is given above can be considered how to space items when their sizes are fixed. However, it can be possible to customize the antenna. For example, the calculation component can have a component configured to design a size of the antenna elements 110 of FIG. 1 to achieve the desire resistance and in turn the desired base frequency. These size of the antenna element 110A or 110B of FIG. 1 can result in the anticipated inductance. A first size calculation component can be configured to calculate a size of the first parasitic feed pad 120A to achieve the anticipated first capacitance to cancel out the first anticipated inductance. Similarly, the second size calculation component can be configured to calculate a size of the second parasitic feed pad 120B of FIG. 1 to achieve the anticipated second capacitance.

The distance component can use the size of the first parasitic feed pad 120A of FIG. 1 and the size of the second parasitic feed pad 120B of FIG. 1. In additionally, the size calculation components and distance calculation component can work in conjunction with one another, deciding the size and distance together for improved (e.g., optimized) results. In one example, a goal can be for the stack antenna to have as low of a physical profile as possible, such as when the ground plane 140 of FIG. 1 is a side of a military vehicle trying to be as small as possible. Therefore, the distance component can attempt to make the stack antenna low profile while making the size of the antenna elements 110 of FIG. 1 and/or the feed pads 120 a reasonable size (e.g., reasonableness defined by preset physical limits, such as size of an available PCB).

Figure 4:
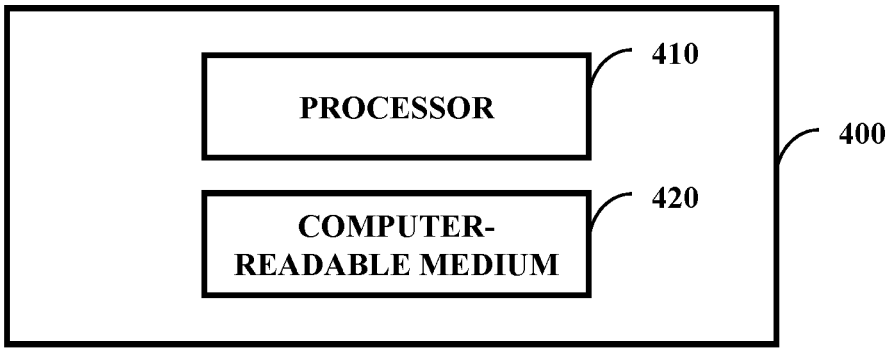
FIG. 4 illustrates one embodiment of a system comprising a processor and a computer-readable medium.

FIG. 4 illustrates one embodiment of a system 400 comprising a processor 410 (e.g., a general purpose processor or a processor specifically designed for performing a functionality disclosed herein) and a computer-readable medium 420 (e.g., non-transitory computer-readable medium). In one embodiment, the computer-readable medium 420 is communicatively coupled to the processor 410 and stores a command set executable by the processor 410 to facilitate operation of at least one component disclosed herein (e.g., the construction component). In one embodiment, at least one component disclosed herein (e.g., the calculation component 310 of FIG. 3 and an output component 320 of FIG. 3) can be implemented, at least in part, by way of non-software, such as implemented as hardware by way of the system 400. In one embodiment, the computer-readable medium 420 is configured to store processor-executable instructions that when executed by the processor 410, cause the processor 410 to perform a method disclosed herein (e.g., the methods 500-600 addressed below).

Figure 5:
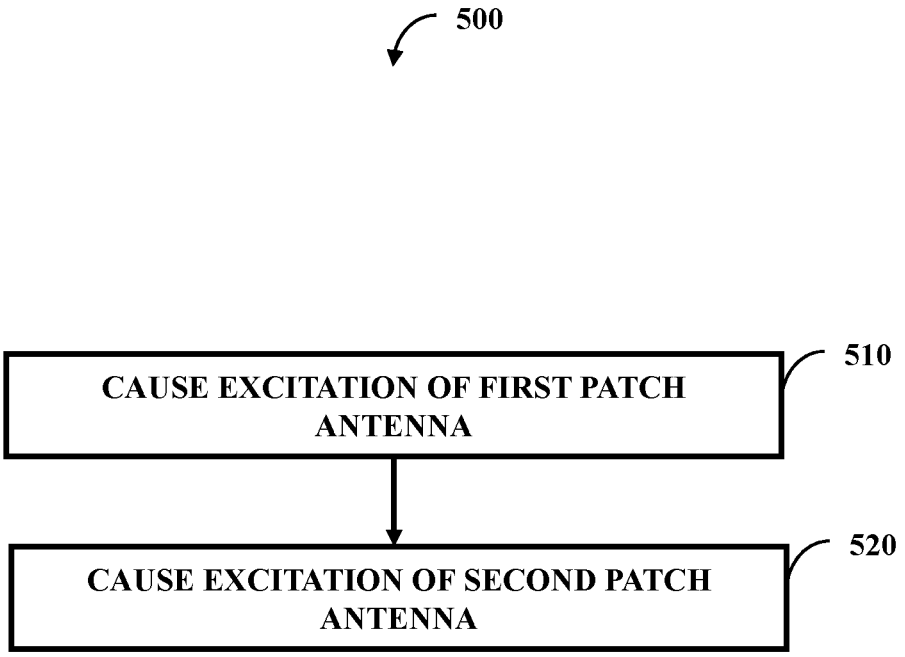
FIG. 5 illustrates one embodiment of a method comprising two actions.

FIG. 5 illustrates one embodiment of a method 500 comprising two actions 510-520. The method 500 can be performed by the probe feed 130 of FIG. 1, such as in conjunction with the feed pads 120 of FIG. 1. At 510, causing excitation of a first patch antenna element can occur to operate at a first base frequency and operate with a first resistance and a first inductance. At 520, causing excitation of a second patch antenna element can take place to operate at a second base frequency and operate with a second resistance and a second inductance. As an example of excitement, associated feed pads can be excited that in turn excite the respective antenna elements.

A parasitic feed pad set (e.g., one or more feed pads, such as the first parasitic feed pad 120A of FIG. 1 and the second parasitic feed pad 120B of FIG. 1) can produce a capacitance that compensates for the first inductance and the second inductance. In one embodiment, the capacitance can comprise the first capacitance (that compensates for the first inductance) and the second capacitance (that compensates for the second inductance). In one embodiment, more than one feed pad cancels inductance of a single antenna element. In one embodiment, a single feed pad produces a capacitance to compensate for more than one antenna element.

Figure 6:
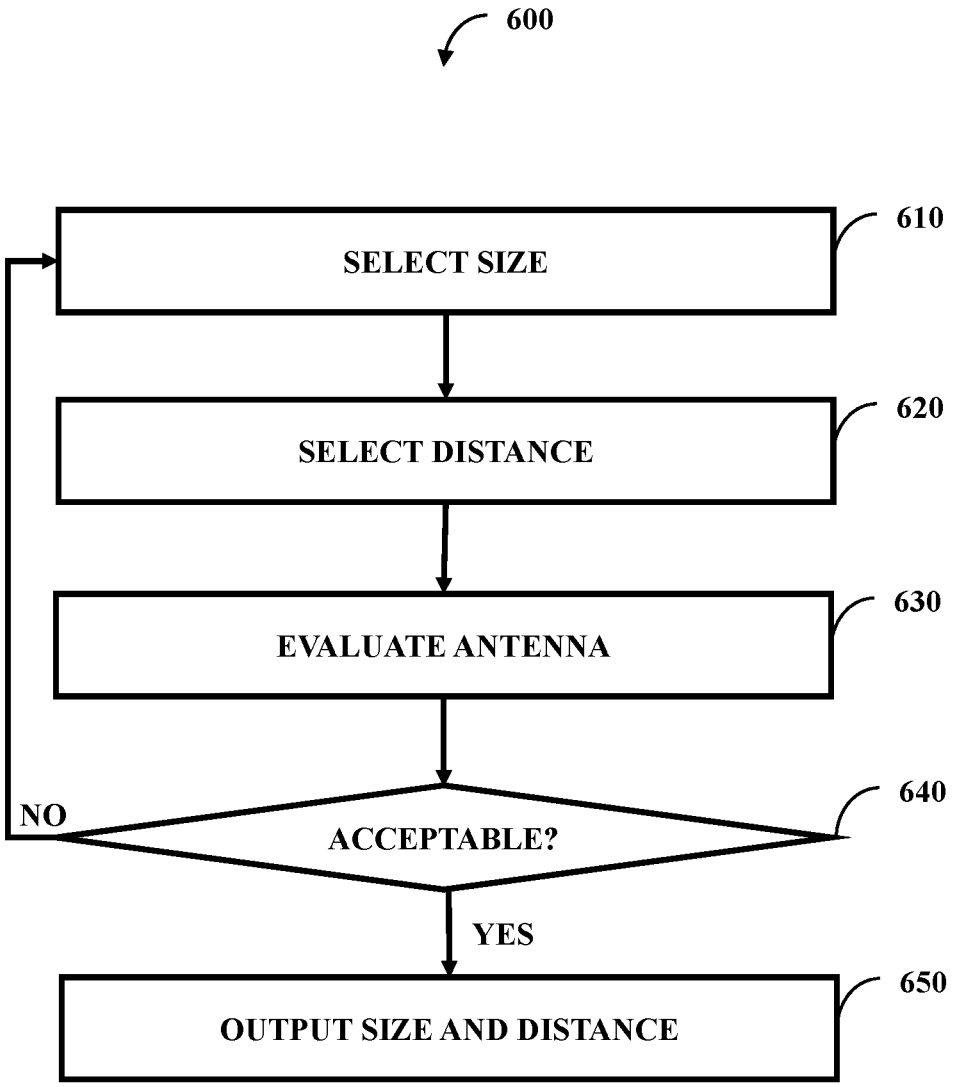
FIG. 6 illustrates one embodiment of a method comprising five actions.

FIG. 6 illustrates one embodiment of a method 600 comprising five actions 610-650. The method 600 can be performed, at least in part, by design apparatus, such as internal logic of a computer numerical control (CNC) machine. At 610, sizes can be selected. These sizes can be sizes of the antenna elements 110 of FIG. 1, the feed pads 120 of FIG. 1, and/or the substrates 210 of FIG. 2. The sizes can include thickness, depth, and width. At 620, distances apart for the sized items can be selected. Actions 610 and 620 can occur concurrently and in coordination with one another. The distance can dictate the size and the size can dictate the distance.

For the feed pads 120 of FIG. 1, the capacitance can be proportional to the area of the feeding pad and the reverse proportional to the distance to the antenna element(s). In one example, distances can be selected so that the feed pads influence one antenna element, but not another. Selection of the sizes and distances can be based, at least in part, on cancelling inductance of the stack antenna (e.g., inductance introduced by the antenna elements 110 of FIG. 1 and/or the probe feed 130 of FIG. 1). In one example, when two feed pads 120A and 120B are employed, they can be designed so they individually cancel their associated antenna element (e.g., physically nearest or with which they share a common substrate) and cancel one half each of inductance introduced by the probe feed 130 of FIG. 1.

With set sizes and distances, there can be a proposed antenna that is evaluated at 630. Evaluation can be performed through mathematical modeling to determine if the sizes and distances cause the impedances and capacitances to cancel one another out to an acceptable level. A check 640 can take place on if the evaluation indicates an acceptable level. If not, then the method can return to action 610 and change at least one size or skip action 610 and change a distance at 620. If the level is acceptable (e.g., the net capacitance/inductance meets a threshold), then at 650 the size and distance can be outputted and the antenna can be constructed (e.g., by the CNC machine).

While the methods disclosed herein are shown and described as a series of blocks, it is to be appreciated by one of ordinary skill in the art that the methods are not restricted by the order of the blocks, as some blocks can take place in different orders. Similarly, a block can operate concurrently with at least one other block.

What is claimed is:

1. A system, comprising:

a first patch antenna element configured to operate at a first base frequency and operate with a first resistance and a first inductance;

a first parasitic feed pad configured to produce a first capacitance configured to at least partially cancel the first inductance;

a second patch antenna element configured to operate at a second base frequency and operate with a second resistance and a second inductance;

a second parasitic feed pad configured to produce a second capacitance configured to at least partially cancel the second inductance, where the first base frequency and the second base frequency are different frequencies.

2. The system of claim 1 a probe feed configured to excite the first patch antenna element, the first parasitic feed pad, the second patch antenna element, and the second parasitic feed pad, where the probe feed introduces a probe feed inductance and where the probe feed inductance is, at least partially, cancelled by the first capacitance, the second capacitance, or a combination thereof.

3. The system of claim 2, where the first patch antenna element, the first parasitic feed pad, the second patch antenna element, and the second parasitic feed pad form a stack, where the first parasitic feed pad separates the first patch antenna element and the second patch antenna element in the stack, and where the second patch antenna element separates the first parasitic feed pad and the second parasitic feed pad in the stack.

4. The system of claim 3, where the stack is based on a ground plane such that the second parasitic feed pad separates the second patch antenna element from the ground plane and where the probe feed is off center of the ground plane.

5. The system of claim 4, where the probe feed and the first patch antenna element do not touch and where the probe feed and the second patch antenna element do not touch.

6. The system of claim 2, where, in response to being excited, the first patch antenna operates at a first band with a center of about the first base frequency, where, in response to being excited, the second patch antenna operates at a second band with a center of about the second base frequency, where the first band has a spread of greater than about 3% of the first base frequency, and where the second band has a spread of greater than about 3% of the second base frequency.

7. The system of claim 6, where the first band and the second band are adjacent.

8. The system of claim 6, where the first band and the second band are not adjacent and where the first band and the second band do not overlap.

9. The system of claim 1, where the first parasitic feed pad is situated between the first patch antenna element and a ground plane and where the first parasitic feed pad has a physical footprint smaller than the first patch antenna element.

10. The system of claim 1, where the first capacitance at least partially cancels the second inductance.

11. The system of claim 1, where the first patch antenna element and the first parasitic feed pad are etched onto opposed sides of a first substrate and where the second patch antenna element and the second parasitic feed pad are etched onto opposed sides of a second substrate.

12. The system of claim 1, where the first capacitance is configured to at least partially cancel the second inductance, where the second capacitance is configured to at least partially cancel the first inductance, and where the first patch antenna element, the first parasitic feed pad, the second patch antenna element, and the second parasitic feed pad form a stack.

13. The system of claim 1, where a stack is formed such that the first parasitic feed pad separates a ground plane from the first patch antenna element, the first patch antenna element separates the first parasitic feed pad and the second parasitic feed pad, and the second parasitic feed pad separates the first antenna patch element from the second antenna patch element.

14. The system of claim 13, where the first patch antenna element and the second patch antenna element have a physical footprint that is about equal, where the first parasitic feed pad and the second parasitic feed pad have a physical footprint that is about equal, and where the physical footprint of the second parasitic feed pad is smaller than the physical footprint of the second patch antenna element.

15. The system of claim 5, where, in response to being excited, the first patch antenna operates at a first band with a center of about the first base frequency, where, in response to being excited, the second patch antenna operates at a second band with a center of about the second base frequency, where the first band has a spread of greater than about 3% of the first base frequency, and where the second band has a spread of greater than about 3% of the second base frequency.

16. The system of claim 1, where the first parasitic feed pad at least partially cancels the first inductance due to its physical shape and its distance from the first patch antenna element, and where the second parasitic feed pad at least partially cancels the second inductance due to its physical shape and its distance from the second patch antenna element.

17. The system of claim 3, where the probe feed is centered to the ground plane, where the probe feed and the first patch antenna element do not touch, and where the probe feed and the second patch antenna element do not touch.

18. The system of claim 15, where the first band and the second band are adjacent, where the first parasitic feed pad is situated between the first patch antenna element and a ground plane, where the first parasitic feed pad has a physical footprint smaller than the first patch antenna element, where the first capacitance at least partially cancels the second inductance, where the first patch element and the first parasitic feed pad are etched onto opposite sides of a first substrate, and where the second patch antenna element and the second parasitic feed pad are etched onto opposite sides of a second substrate.

19. The system of claim 18, where the probe feed is configured to excite the first patch antenna element, the first parasitic feed pad, the second patch antenna element, and the second parasitic feed pad such that left hand polarization is achieved.

20. The system of claim 15, where the first band and the second band are not adjacent, where the first band and the second band do not overlap, where the first parasitic feed pad is situated between the first patch antenna element and a ground plane, where the first parasitic feed pad has a physical footprint smaller than the first patch antenna element, where the first capacitance at least partially cancels the second inductance, where the first patch element and the first parasitic feed pad are etched onto opposite sides of a first substrate, and where the second patch antenna element and the second parasitic feed pad are etched onto opposite sides of a second substrate.

* * * * *